US010584436B2

(12) United States Patent
Lee et al.

(10) Patent No.: US 10,584,436 B2
(45) Date of Patent: Mar. 10, 2020

(54) WASHING MACHINE AND METHOD FOR CONTROLLING SAME

(71) Applicant: Samsung Electronics Co., Ltd, Gyeonggi-do (KR)

(72) Inventors: Seung Hun Lee, Gyeonggi-do (KR); Jun Hyun Park, Gyeonggi-do (KR); Sung Mo Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 247 days.

(21) Appl. No.: 15/115,634

(22) PCT Filed: Jan. 26, 2015

(86) PCT No.: PCT/KR2015/000782
§ 371 (c)(1),
(2) Date: Jul. 29, 2016

(87) PCT Pub. No.: WO2015/115760
PCT Pub. Date: Aug. 6, 2015

(65) Prior Publication Data

US 2017/0167067 A1 Jun. 15, 2017

(30) Foreign Application Priority Data

Jan. 29, 2014 (KR) ..... 10-2014-0011407

(51) Int. Cl.
*D06F 37/20* (2006.01)
*D06F 39/00* (2006.01)
(Continued)

(52) U.S. Cl.
CPC ..... *D06F 37/203* (2013.01); *D06F 33/02* (2013.01); *D06F 39/003* (2013.01); *D06F 23/04* (2013.01);
(Continued)

(58) Field of Classification Search
CPC .. D06F 39/003; D06F 37/203; D06F 2202/10; D06F 2202/065; D06F 2204/065
See application file for complete search history.

(56) References Cited

U.S. PATENT DOCUMENTS 4,862,710 A 9/1989 Torita et al.
4,953,369 A * 9/1990 Ito ..... D06F 37/40 192/17 R
(Continued)

FOREIGN PATENT DOCUMENTS

CN 1547632 A 11/2004
CN 1821477 A 8/2006
(Continued)

OTHER PUBLICATIONS

JP2000325687—Machine Translation (Year: 2000).*
(Continued)

*Primary Examiner* — Marc Lorenzi

(57) ABSTRACT

The present invention relates to a washing machine and a control method thereof. The method of controlling the washing machine may include accelerating a motor, and detecting a weight of laundry inside a washing tub; and providing a force in a direction opposite to a rotating direction of the motor to the motor, and decelerating the motor.

9 Claims, 13 Drawing Sheets

(51) Int. Cl.

| | |
|---|---|
| ***D06F 33/02*** | (2006.01) |
| *D06F 23/04* | (2006.01) |
| *D06F 37/40* | (2006.01) |
| *D06F 37/30* | (2020.01) |
| *D06F 37/36* | (2006.01) |

(52) U.S. Cl.
CPC ..... *D06F 37/304* (2013.01); *D06F 37/36* (2013.01); *D06F 37/40* (2013.01); *D06F 2202/065* (2013.01); *D06F 2202/10* (2013.01); *D06F 2204/065* (2013.01)

(56) References Cited

U.S. PATENT DOCUMENTS

| | | | | |
|---|---|---|---|---|
| 5,937,467 | A * | 8/1999 | Kim | D06F 37/42 8/159 |
| 2002/0046581 | A1* | 4/2002 | Shimakage | D06F 37/203 68/12.04 |
| 2003/0020431 | A1* | 1/2003 | Kiuchi | D06F 37/304 318/779 |
| 2003/0034054 | A1* | 2/2003 | Lee | D06F 37/40 134/22.18 |
| 2004/0045097 | A1 | 3/2004 | Kim et al. | |
| 2005/0028299 | A1* | 2/2005 | Jeon | D06F 39/003 8/159 |
| 2005/0120492 | A1 | 6/2005 | Koo et al. | |
| 2006/0179584 | A1 | 8/2006 | Choi et al. | |
| 2008/0041115 | A1* | 2/2008 | Kanazawa | D06F 33/02 68/12.04 |
| 2009/0112513 | A1* | 4/2009 | Filippa | D06F 39/003 702/175 |
| 2009/0199598 | A1* | 8/2009 | Kanazawa | D06F 33/02 68/12.04 |
| 2012/0112683 | A1* | 5/2012 | Suel, II | D06F 33/02 318/760 |

FOREIGN PATENT DOCUMENTS

| | | | |
|---|---|---|---|
| CN | 101130921 | A | 2/2008 |
| CN | 103485131 | A | 1/2014 |
| CN | 103741430 | A | 4/2014 |
| JP | 2000325687 | A * | 11/2000 |
| JP | 2011-104141 | | 6/2011 |
| KR | 10-1996-0004615 | | 2/1996 |
| KR | 10-2011-0022494 | | 3/2011 |
| KR | 10-2011-0119123 | | 11/2011 |

OTHER PUBLICATIONS

State Intellectual Property Office of the People's Republic of China First Office Action, regarding Application No. 201580005308.8, dated Feb. 24, 2018, 21 pages.
International Search Report dated Apr. 17, 2015 in connection with International Application No. PCT/KR2015/000782, 10 pages.
Written Opinion of the International Searching Authority dated Apr. 17, 2015 in connection with International Application No. PCT/KR2015/000782, 7 pages.
Office Action dated Nov. 6, 2018 in connection with Chinese Patent Application No. 201580005308.8, 17 pages.

* cited by examiner

WASHING MACHINE AND METHOD FOR CONTROLLING SAME

CROSS-REFERENCE TO RELATED APPLICATION(S)

The present application claims priority under 35 U.S.C. § 365 to International Patent Application No. PCT/KR2015/000782 filed Jan. 26, 2015, entitled "WASHING MACHINE AND METHOD FOR CONTROLLING SAME", and, through International Patent Application No. PCT/KR2015/000782, to Korean Patent Application No. 10-2014-0011407 filed Jan. 29, 2014, each of which are incorporated herein by reference into the present disclosure as if fully set forth herein.

TECHNICAL FIELD

The present invention relates to a washing machine which calculates a weight of laundry inside a washing tub before a main process, and a control method thereof.

BACKGROUND ART

Generally, a washing machine (e.g., a fully automatic washing machine) includes a tub which stores water (washing water or rinsing water), a washing tub which is rotatably installed inside the tub and accommodates laundry, a pulsator which is rotatably installed inside the washing tub and generates a water stream, and a motor which generates a driving force for rotating the washing tub and the pulsator, and serves to remove contaminants of the laundry using surface activity of a detergent and the water stream.

The washing machine performs a washing operation through a series of processes including a washing process which separates the contaminants of the laundry with the water (specifically, the washing water) containing the dissolved detergent, a rinsing process which rinses bubbles or remaining detergent of the laundry with the water (specifically, the rinsing water) not containing the detergent, and a spin-drying process which removes the water contained in the laundry by high speed rotation. When the washing operation is performed through the series of processes, the motor is driven with a target RPM and operation ratio in each of the washing process, the rinsing process and the spin-drying process.

The motor RPM and operation ratio in each process is set according to a weight (a load) of the laundry, and the motor is rotated at a speed determined by the set RPM and operation ratio. Therefore, recently, a study on a method of detecting the weight of the laundry is being carried out to optimize a water level and the washing process before the main process.

DISCLOSURE

Technical Problem

The present invention is directed to providing a washing machine which reduces a weight calculating time and also reduces a noise generated when a rotor is accelerated and decelerated, and a control method thereof.

Technical Solution

One aspect of the present invention provides a washing machine including a driving part including an inverter and a motor; a detection part configured to detect a rotational displacement of the motor; a weight calculation part configured to detect a weight of laundry inside a washing tub through the rotational displacement of the motor detected by the detection part when the motor is accelerated; and a control part configured to accelerate the motor, to control the weight calculation part to detect the weight of the laundry, to provide a force in a direction opposite to a rotating direction of the motor to the motor, and thus to decelerate the motor.

The washing machine may further include a brake assembly configured to stop the motor.

The control part may control acceleration and deceleration of the motor through a closed circuit speed control and an open circuit current control.

Another aspect of the present invention provides a method of controlling a washing machine, including accelerating a motor, and detecting a weight of laundry inside a washing tub; and providing a force in a direction opposite to a rotating direction of the motor to the motor, and decelerating the motor.

When the motor is decelerated, a q-axial current may be applied to the motor in a negative direction, and thus the force in the direction opposite to the rotating direction of the motor may be provided to the motor, and in this case, a voltage rise due to the q-axial current may be reduced by applying a d-axial current to the motor in a positive direction.

Advantageous Effects

According to the above-described washing machine and the control method thereof, the rotor is decelerated to a predetermined speed by providing the force in the direction opposite to the rotating direction of the rotor, and stops the rotor using the brake assembly, thereby reducing a weight calculation time and also reducing a generated noise.

MODES OF THE INVENTION

Various embodiments of the present invention will be described herein below with reference to the accompanying drawings. In the following description, however, detailed descriptions of well-known functions or constructions will be omitted if they would obscure the invention in unnecessary detail.

Also, the terms used herein are defined according to the functions of the present invention. Thus, the terms may vary depending on user's or operator's intentions or practices. Thus, the meanings of the terms used in the following embodiments shall follow the definitions if defined herein, otherwise shall have the same meaning as is commonly understood by one of skill in the art to which this invention belongs.

In addition, while aspects selectively described or configurations of the embodiments selectively described in this specification are illustrated in a single, unified configuration in drawings, otherwise defined, it should be understood by those skilled in the art that configurations can be combined freely with each other unless technically contradictable.

Hereinafter, one embodiment of a washing machine and a control method thereof will be described with reference to the accompanying drawings.

A motor which will be described below is described with a three-phase brushless direct current motor, but the motor is not limited to the three-phase brushless direct current motor.

Hereinafter, a configuration of a washing machine according to one embodiment will be described with reference to FIG. 1.

Figure 1:
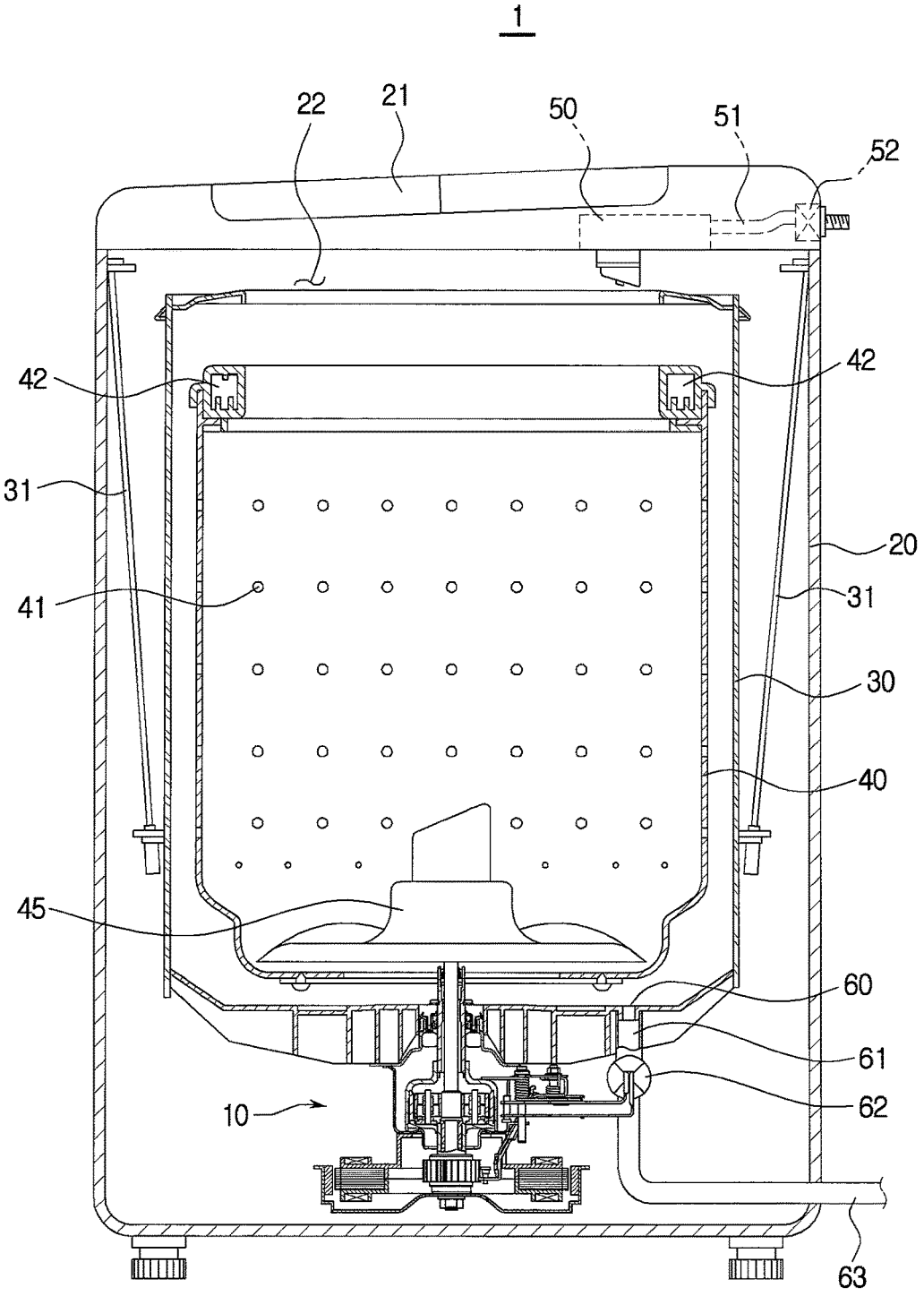
FIG. 1 is a cross-sectional view illustrating a washing machine according to one embodiment.

FIG. 1 is a cross-sectional view of a washing machine.

A washing machine 1 may include a cabinet 20 which forms an exterior, a tub 30 which is disposed inside the cabinet 20 and stores water, a washing tub 40 which is rotatably disposed inside the tub 30, a pulsator 45 which is disposed inside the washing tub 40 and generates a water stream, and a driving unit 10 which rotates the washing tub 40 or the pulsator 45.

An opening 22 through which laundry is put into the washing tub 40 is formed at an upper portion of the cabinet 20, and the opening 22 may be opened and closed by a door 21 installed at the upper portion of the cabinet 20.

The tub 30 may be hung in the cabinet 20 and may be supported by a suspension unit 31 which connects a lower side of an outer surface of the tub 30 with an upper portion of an inside of the cabinet 20. The suspension unit 31 may damp vibration generated at the tub 30 during a washing process or a spin-drying process.

A water pipe 51 which supplies the water into the tub 30 is installed above the tub 30. One side of the water pipe 51 is connected to an external water source, and the other side of the water pipe 51 is connected to a detergent supply unit 50. The water supplied through the water pipe 51 may pass through the detergent supply unit 50 and thus may be supplied into the tub 30 together with a detergent. A water supply valve 52 installed at the water pipe 51 may control supply of the water.

The washing tub 40 is formed in a cylindrical shape of which an upper portion is opened, and the laundry is accommodated therein. Also, a plurality of dewatering holes 41 are provided at a side surface of the washing tub 40. The plurality of dewatering holes 41 enable an internal space of the washing tub 40 to be in communication with an internal space of the tub 30. Also, a balancer 42 is installed at an upper portion of the washing tub 40. The balancer 42 may offset an unbalanced load generated at the washing tub 40 while the washing tub 40 is rotated at a high speed, and thus may guide the washing tub 40 to be stably rotated.

The pulsator 45 is rotated in a normal direction or a reverse direction and generates the water stream, and the laundry inside the washing tub 40 may be agitated with the water by the generated water stream.

A drainage hole 60 is formed at a bottom of the tub 30. The drainage hole 60 provides a space so that the water stored in the tub 30 is discharged. Also, a first drainage pipe 61 is connected to the drainage hole 60. Also, a drainage valve 62 is installed at the first drainage pipe 61, and the drainage valve 62 may control drainage.

A second drainage pipe 63 may be connected to an outlet port of the drainage valve 62, and the second drainage pipe 63 may provide a space so that the water is discharged to an outside. The drainage valve 62 may be a solenoid unit or a link unit connected to an electric drive motor. And also, various units for discharging the water inside the tub 30 to the outside may be used as an example of the drainage valve 62.

The driving unit 10 is provided at a lower side of the tub 30 to selectively provide a rotating force to the washing tub 40 or the pulsator 45. Specifically, the driving unit 10 may provide the rotating force to the pulsator 45 in the normal direction or the reverse direction during the washing process and a rinsing process, and may also provide the rotating force to the washing tub 40 and the pulsator 45 in the reverse direction during the spin-drying process.

Hereinafter, one embodiment of the driving unit will be described with reference to FIG. 2

Figure 2:
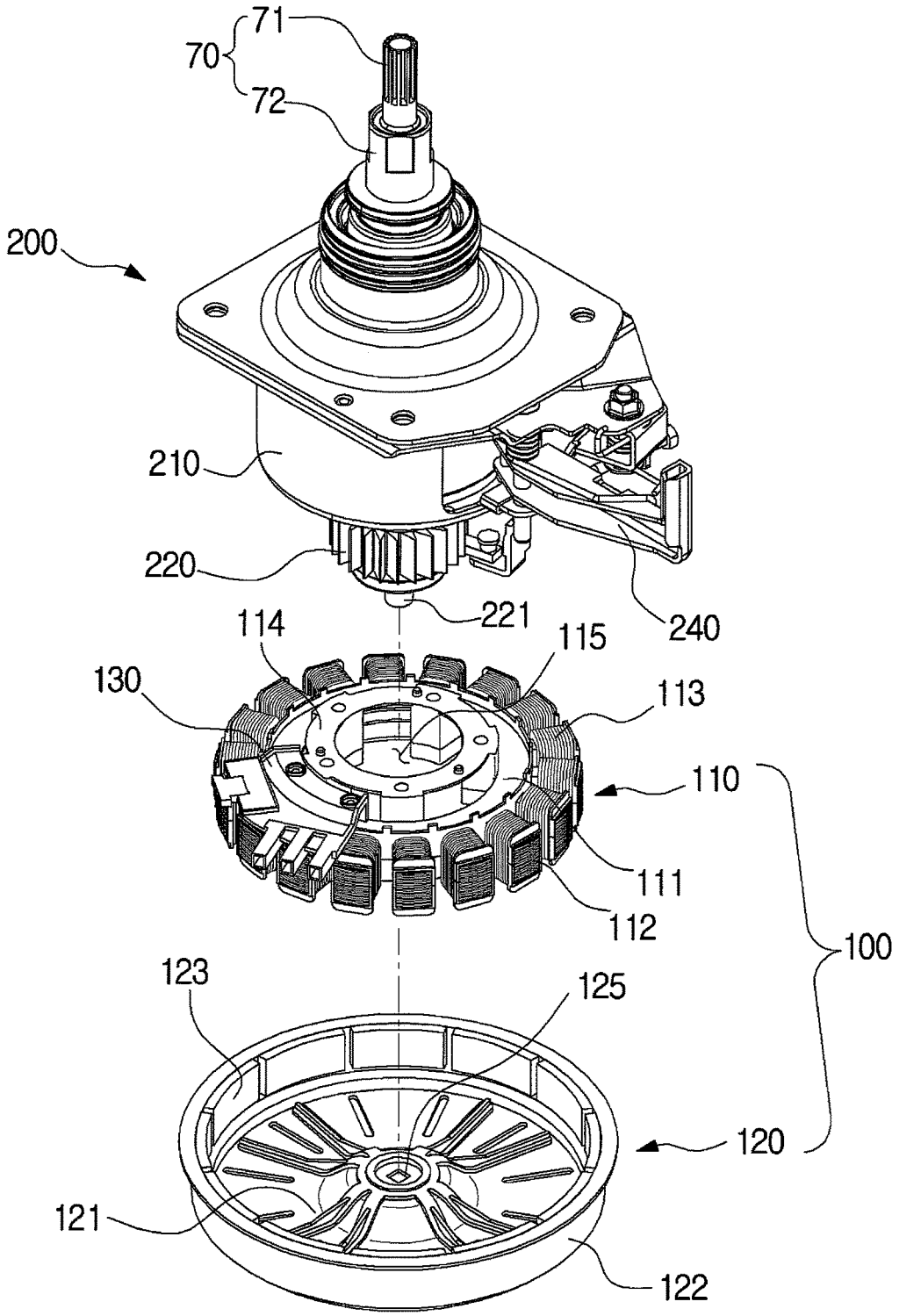
FIG. 2 is a perspective view illustrating a state in which a driving unit included in the washing machine according to one embodiment is disassembled.
Figure 3:
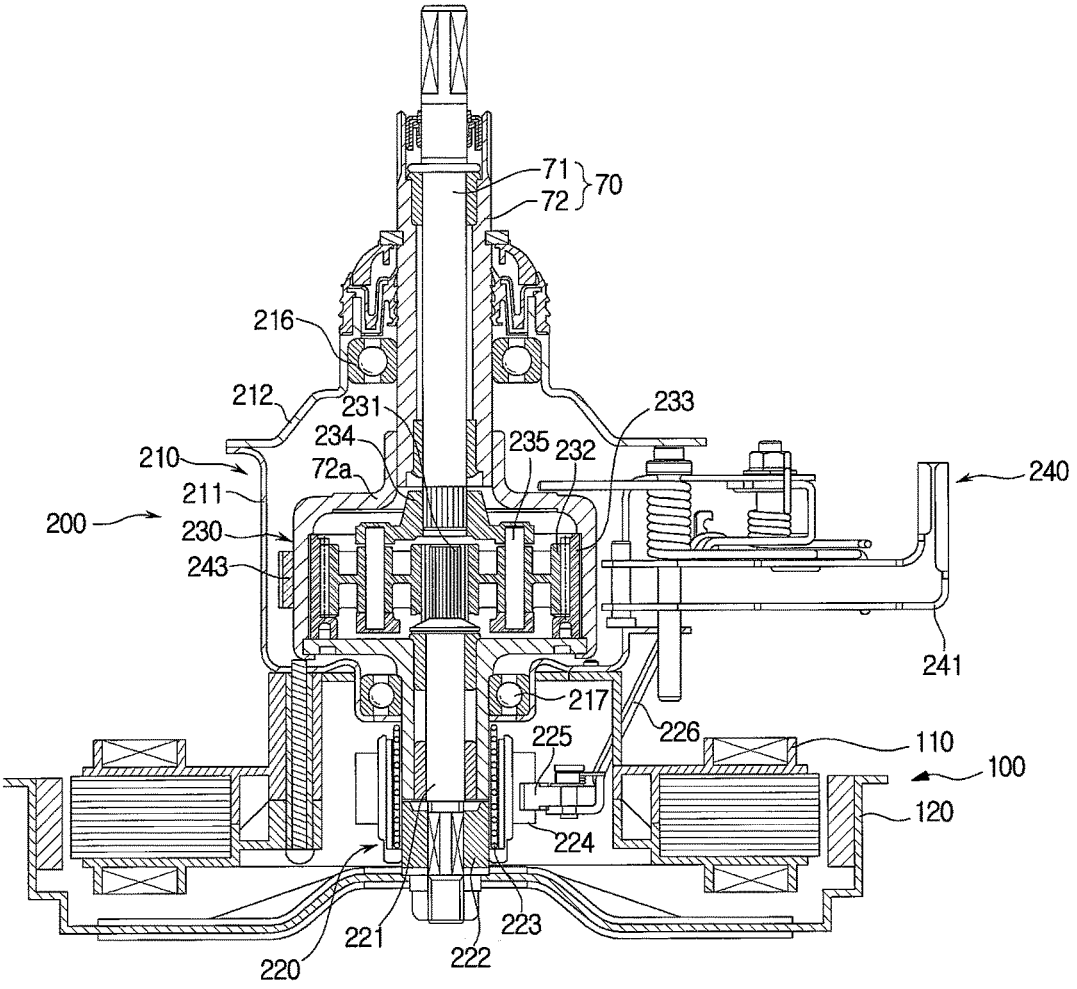
FIG. 3 is a cross-sectional view of the driving unit included in the washing machine according to one embodiment.

FIG. 2 is a perspective view illustrating a state in which the driving unit included in the washing machine according to one embodiment is disassembled, and FIG. 3 is a cross-sectional view of the driving unit included in the washing machine according to one embodiment.

The driving unit 10 may include a driving motor 100 which receives electric power and generates a driving force, a driving shaft 70 which transmits the rotating force generated from the driving motor 100 to the washing tub 40 and the pulsator 45, and a clutch 200 which controls rotation of the driving shaft 70 so that the driving shaft 70 simultaneously or selectively rotates the pulsator 45 and the washing tub 40.

Specifically, the driving unit 10 has a direct drive (DD) structure in which the driving motor 100, the clutch 200 and the driving shaft 70 are arranged in one line, and thus this is called as a DD motor by those skilled in the art. Since the driving unit 10 has the DD structure, the washing machine 1 may primarily control a rotating speed and a torque of the washing tub 40 using the driving motor 100, and then may secondarily control them using the clutch 200.

The driving shaft 70 may include a spin-drying shaft 72 which transmits the rotating force to the washing tub 40, and a washing shaft 71 which rotates the pulsator 45.

The spin-drying shaft 72 has a hollow, and the washing shaft 71 and a rotating shaft 221 of the clutch 200 which will be described below are located inside the hollow of the spin-drying shaft 72. Also, a reduction gear accommodation part 72*a* in which a reduction gear assembly 230 which will be described below is accommodated is formed at a center of the spin-drying shaft 72.

The driving motor 100 may include a stator 110 which is fixed to the clutch 200, and a rotor 120 which is disposed to surround the stator 110 and rotated by an electromagnetic interaction with the stator 110.

The stator 110 may include an annular base 111, a plurality of teeth 112 which are arranged along an outer circumference of the base 111 and protrude outward in a radial direction of the stator 110, and a coil 113 which is wound on each of the plurality of teeth 112. The coil 113 may generate a magnetic field by a current flowing through the coil 113, and the plurality of teeth 112 may be magnetized by the generated magnetic field.

An annular installation surface 114 is formed at an upper side of the base 111, and when the stator 110 is coupled to the clutch 200, the clutch 200 is seated on the installation surface 114.

An opening 115 is formed inside the base 111 and the installation surface 114. When the clutch 200 and the stator 110 are coupled to each other, a switching gear assembly 220 and a lower protruding part 215 may pass through the opening 115, and may be disposed inside the stator 110.

The rotor 120 includes a bottom surface 121 and a side wall 122 which protrudes from a boundary of the bottom surface 121. A plurality of permanent magnets 123 are coupled to an inner surface of the side wall 122, and magnetically interacts with the coil 113 of the stator 110, and thus the rotor 120 is rotated.

A coupling hole 125 is formed at a center of a protruding part 121, and thus the rotating shaft 221 of the clutch 200 may be coupled to the rotor 120 using a fastening member.

The rotating shaft 221 coupled to the rotor 120 passes through the hollow of the spin-drying shaft 72, and is connected to the washing shaft 71 at the reduction gear assembly 230, and the washing shaft 71 passes again through the hollow of the spin-drying shaft 72, and is coupled to the pulsator 45.

The clutch 200 may include a clutch body 210 which forms an exterior thereof, the switching gear assembly 220 which is disposed at a lower portion of the clutch body 210 and selectively transmits the rotating force of the rotating shaft 221 coupled to the rotor 120 of the driving motor 100 to the washing shaft 71 and the spin-drying shaft 72 according to an operation of the washing machine, the reduction gear assembly 230 which is provided inside the reduction gear accommodation part 72*a* of the spin-drying shaft 72 to decelerate the rotation of the rotating shaft 221 and then to transmit the decelerated rotating force to the washing shaft 71, and a brake assembly 240 which is provided outside the reduction gear accommodation part 72*a* of the spin-drying shaft 72 and brakes the rotation of the washing tub 40.

The clutch body 210 may include a cylindrical housing 211 of which an upper portion is opened, and a housing cover 212 which covers the upper portion of the housing 211.

The driving shaft 70 which extends toward the tub 30 is located at a center of the housing cover 212, and an upper portion of the housing cover 212 protrudes toward the tub 30 while surrounding the driving shaft 70.

The rotating shaft 221 which extends toward the driving motor 100 is located at a center of a lower side of the housing 211, and a lower portion of the housing 211 protrudes toward the driving motor 100 while surrounding the rotating shaft 221.

An upper bearing 216 is provided between the housing cover 212 and the spin-drying shaft 72, and a lower bearing 217 is provided between the housing 211 and the rotating shaft 221, and thus the spin-drying shaft 72 and the rotating shaft 221 may be guided to be smoothly rotated. Also, the upper bearing 216 may be a one-way bearing which enables the spin-drying shaft 72 to be rotated in only one direction. That is, the upper bearing 216 may enable the spin-drying shaft 72 to be rotated in only the normal direction but not to be rotated in the reverse direction.

Since the housing cover 212 is fixed to a lower portion of the tub 30, the clutch body 210 is supported by the tub 30. Also, the housing cover 212 is fixed to and supported by an upper portion of the stator 110.

The switching gear assembly 220 may include the rotating shaft 221 which is provided at the hollow of the spin-drying shaft 72 and receives the rotating force from the driving motor 100, a rotating shaft boss 222 which has the same diameter as that of the spin-drying shaft 72 and is coupled to the rotating shaft 221, a clutch spring 223 which surrounds the spin-drying shaft 72 and the rotating shaft boss 222 and selectively transmits the rotating force of the rotating shaft 221 to the spin-drying shaft 72, a sleeve 224 which is provided outside of the clutch spring 223, a latch 225 which is provided close to the sleeve 224 and changes a diameter of the clutch spring 223, and a clutch lever 226 which is connected to the latch 225.

One end of the clutch spring 223 is connected to the spin-drying shaft 72, and the other end thereof is connected to the sleeve 224. Also, the clutch spring 223 may be tightened or loosed according to an operation of the latch 225.

Specifically, an inner diameter of the clutch spring 223 is smaller than an outer diameter of the rotating shaft boss 222, and an outer diameter of the spin-drying shaft 72. Therefore, the clutch spring 223 may be usually maintained in a tightened state, and then may be loosed when the latch 225 is operated. When the clutch spring 223 is tightened, the rotating force of the rotating shaft 221 is transmitted to the spin-drying shaft 72, and when the clutch spring 223 is loosed, the rotating force of the rotating shaft 221 is not transmitted to the spin-drying shaft 72.

According to an operation of the clutch lever 226 connected to the latch 225, the latch 225 may be in contact with the sleeve 224, and may rotate the sleeve 224 in a direction that the clutch spring 223 is loosed, or may be separated from the sleeve 224.

In an operation of the switching gear assembly 220, the clutch lever 226 is pulled to one side during the washing process or the rinsing process, and the latch 225 is in contact with the sleeve 224, and thus the latch 225 rotates the sleeve 224 in the direction that the clutch spring 223 is loosed. Like this, when the sleeve 224 is rotated by the latch 225, the clutch spring 223 inside the sleeve 224 is loosed, and the rotating force of the rotating shaft 221 is not transmitted to the spin-drying shaft 72. As a result, even while the washing shaft 71 is rotated, the spin-drying shaft 72 may not be rotated, and thus the pulsator 45 connected to the washing shaft 71 may be rotated, but the washing tub 40 connected to the spin-drying shaft 72 may not be rotated.

On the contrary to this, when the clutch lever 226 is pulled to the other side during the spin-drying process, the latch 225 is separated from the sleeve 224, and thus the clutch spring 223 is tightened again by rotation of the sleeve 224. Also, the clutch spring 223 transmits the rotating force of the rotating shaft 221 to the spin-drying shaft 72. As a result, both of the pulsator 45 connected to the washing shaft 71 and the washing tub 40 connected to the spin-drying shaft 72 may be rotated.

The reduction gear assembly 230 is provided inside the reduction gear accommodation part 72*a* formed in the proximity of the center of the spin-drying shaft 72.

And the reduction gear assembly 230 may include a sun gear 231 which is coupled to the rotating shaft 221, a plurality of planet gears 232 which are disposed around the sun gear 231, an internal gear 233 which is formed at an inner surface of the reduction gear accommodation part 72*a*, and a carrier 234 which transmits a rotating force generated by revolution of the plurality of planet gears 232 to the washing shaft 71.

At this point, one side of each of the plurality of planet gears 232 may be engaged with the sun gear 231, and the other side thereof may be engaged with the internal gear 233.

When the sun gear 231 is rotated, each of the plurality of planet gears 232 is rotated (rotation) about a planet gear shaft 235 connected to the carrier 234, and also rotated (revolution) along the internal gear 233 around the sun gear 231 together with the planet gear shaft 235. Therefore, the rotation (revolution) of the planet gear shaft 235 may be transmitted to the washing shaft 71 through the carrier 234.

The brake assembly 240 may include a brake band 243 which is provided outside the reduction gear accommodation part 72*a* provided in the proximity of the center of the spin-drying shaft 72 and brakes the spin-drying shaft 72, and a brake lever 241 which is connected to the brake band 243.

An operation of the brake assembly 240 will be described in detail with reference to FIGS. 4*a* and 4*b*.

Figure 4A:
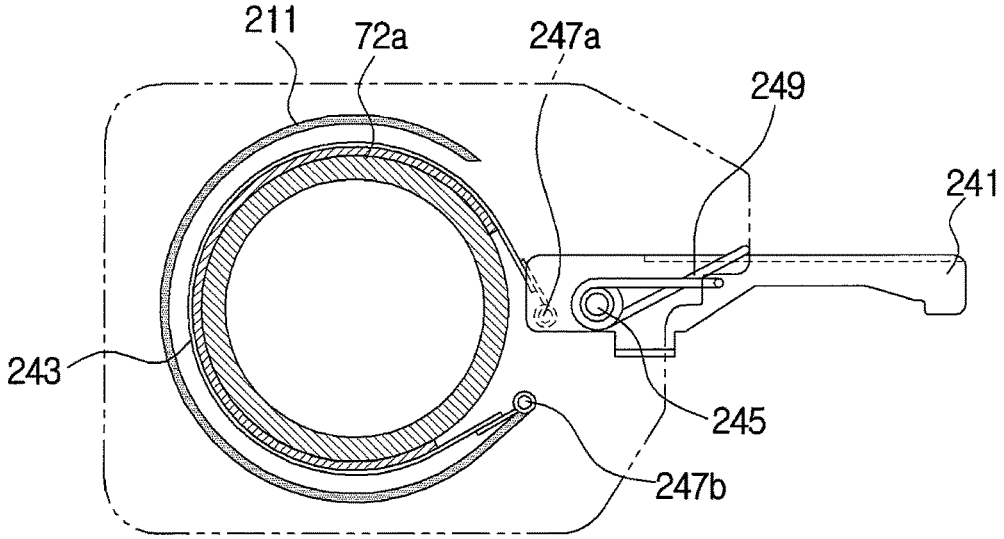
FIG. 4*a* is a view illustrating a state in which a brake assembly included in the washing machine according to one embodiment performs a braking operation.
Figure 4B:
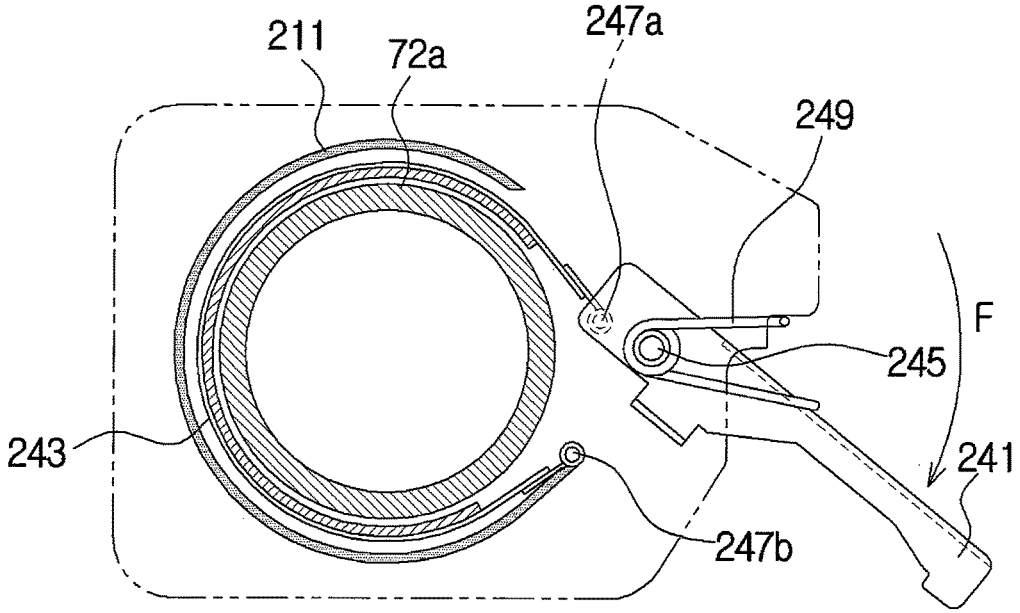
FIG. 4*b* is a view illustrating a state in which the brake assembly included in the washing machine according to one embodiment does not perform the braking operation.

FIG. 4*a* is a view illustrating a state in which the brake assembly included in the washing machine according to one embodiment performs a braking operation, and FIG. 4*b* is a view illustrating a state in which the brake assembly included in the washing machine according to one embodiment does not perform the braking operation.

The brake assembly 240 may include the brake band 243 and the brake lever 241.

Also, the brake band 243 is fixed by a first hinge 247*a* provided at the brake lever 241 and a second hinge 247*b* provided at the housing 211, and the brake lever 241 is provided to be rotatable about a lever shaft 245.

As illustrated in FIG. 4*a*, when an external force is not applied, the brake lever 241 may pull the brake band 243 due to an elastic force of a clutch spring 223 so that the brake band 243 is in close contact with the reduction gear accommodation part 72*a* of the spin-drying shaft 72. Like this, when the brake band 243 is in close contact with the reduction gear accommodation part 72*a*, the brake band 243 may prevent the reduction gear accommodation part 72*a* from being rotated in a clockwise direction (the normal direction).

Specifically, since one side of the brake band 243 is fixed to the housing 211 by the second hinge 247*b*, when the reduction gear accommodation part 72*a* is rotated in the clockwise direction (the normal direction), the brake band 243 is in close contact with the reduction gear accommodation part 72*a*, and thus the brake band 243 may provide a braking force to the reduction gear accommodation part 72*a*.

However, since the other side of the brake band 243 is fixed to the brake lever 241, which is rotatable, by the first hinge 247*a*, when the reduction gear accommodation part 72*a* is rotated in a counterclockwise direction (the reverse direction), the brake band 243 may pull the brake lever 241, and thus the brake lever 241 may be rotated. Therefore, the brake band 243 may not be in close contact with the reduction gear accommodation part 72*a*, and thus the brake band 243 may not provide the braking force to the reduction gear accommodation part 72*a*.

Eventually, when the external force is not applied to the brake lever 241, the brake band 243 may prevent the rotation of the spin-drying shaft 72 in the normal direction, but may not prevent the rotation of the spin-drying shaft 72 in the reverse direction.

On the contrary, as illustrated in FIG. 4*b*, when the external force is applied to the brake lever 241, the brake lever 241 is rotated in one direction (a downward direction in FIG. 4*b*), and thus the brake band 243 and the reduction gear accommodation part 72*a* may be spaced apart from each other. Like this, when the brake band 243 is spaced apart from the reduction gear accommodation part 72*a*, the reduction gear accommodation part 72*a*, the spin-drying shaft 72 and the washing tub 40 may be freely rotated.

Hereinafter, a flow of the operation of the washing machine according to one embodiment will be described with reference to FIG. 5.

Figure 5:
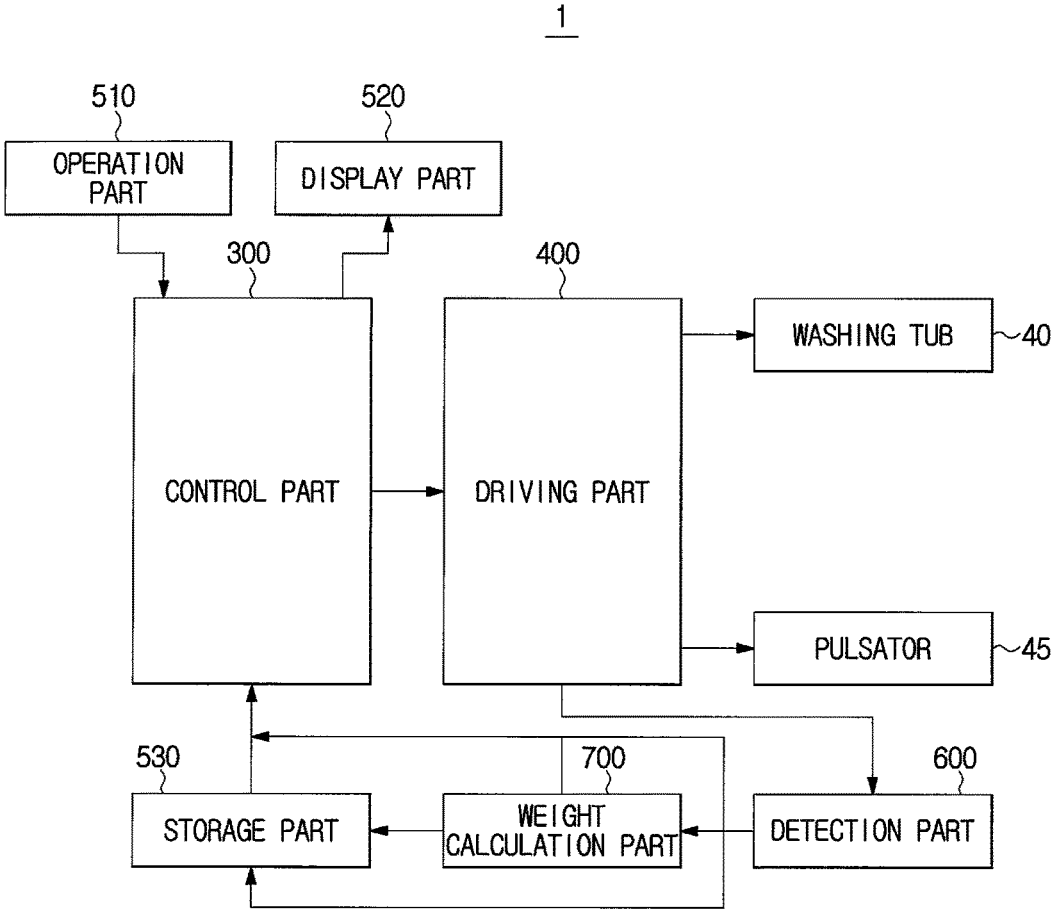
FIG. 5 is a block diagram illustrating a control flow of the washing machine according to one embodiment.

FIG. 5 is a block diagram illustrating a control flow of the washing machine according to one embodiment.

The washing machine 1 may include an operation part 510 which receives a user's operation command, a display part 520 which displays operation information of the washing machine 1, a storage part 530 which stores a program and data related to the operation of the washing machine 1, a driving part 400 which drives the washing tub 40 and the pulsator 45, a detection part 600 which detects an operating state of the driving part 400, a weight calculation part 700 which calculates a weight of the laundry inside the washing tub 40 using data detected by the detection part 600, and a control part 300 which controls the operation of the washing machine 1.

The operation part 510 may include a plurality of operation buttons through which the operation command for the washing machine 1 is received.

The operation buttons may include a washing course input button for selecting a washing course, a washing time input button for inputting a time of performing the washing process, a rinsing times input button for inputting the number of the rinsing processes, and a spin-drying time input button for inputting a time of performing the spin-drying process. A user may input an input command for setting a washing operation through the operation buttons, and then may input the washing course, the washing time, the number of rinsing processes and the spin-drying time through a dial.

Also, a membrane switch, a touch pad or the like may be used as the operation buttons. And various kinds of other input units may also be used as an example of the operation buttons.

The display part 520 may include a display panel which displays the operation information of the washing machine 1.

The display panel may display the washing course, the washing time, the number of rinsing processes, the spin-drying time, a washing process remaining time and so on, which are input by the user.

A liquid crystal display (LCD) panel or a light emitting diode (LED) panel may be used as the display panel. And various kinds of other display units may be used as an example of the display panel.

The storage part 530 may include a non-volatile memory, such as a magnetic disc and a solid state disk, which permanently stores the control program and the control data for controlling the operation of the washing machine 1, and a volatile memory, such as a D-RAM and an S-RAM, which temporarily stores temporary data generated while an operation of the driving motor 100 is controlled.

The driving part 400, the detection part 600, the weight calculation part 700 and the control part 300 will be described in detail with reference to FIGS. 6 to 8.

Figure 6:
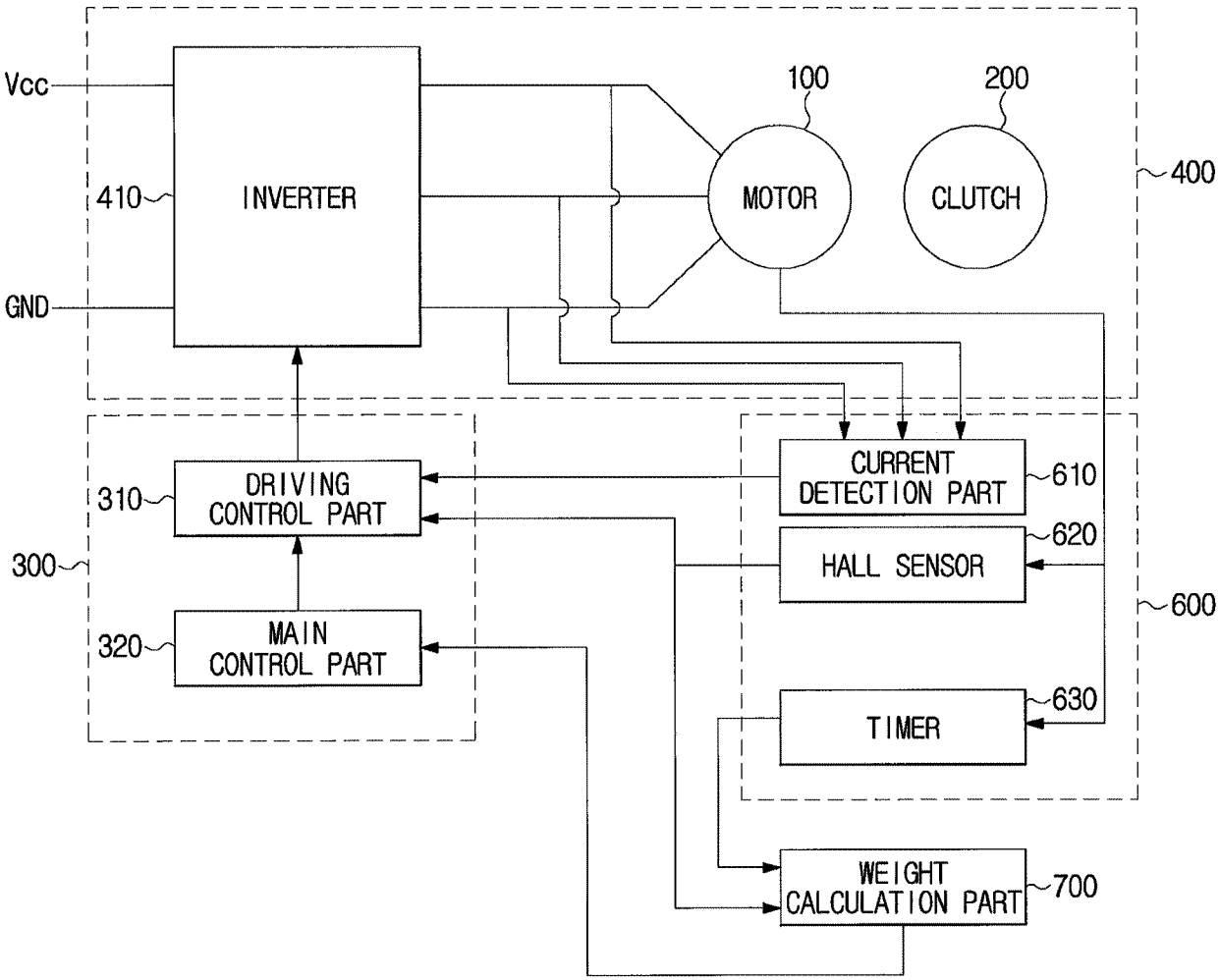
FIGS. 6 to 8 are block diagrams of a driving part, a detection part, a control part and a weight calculation part according to one embodiment.
Figure 7:
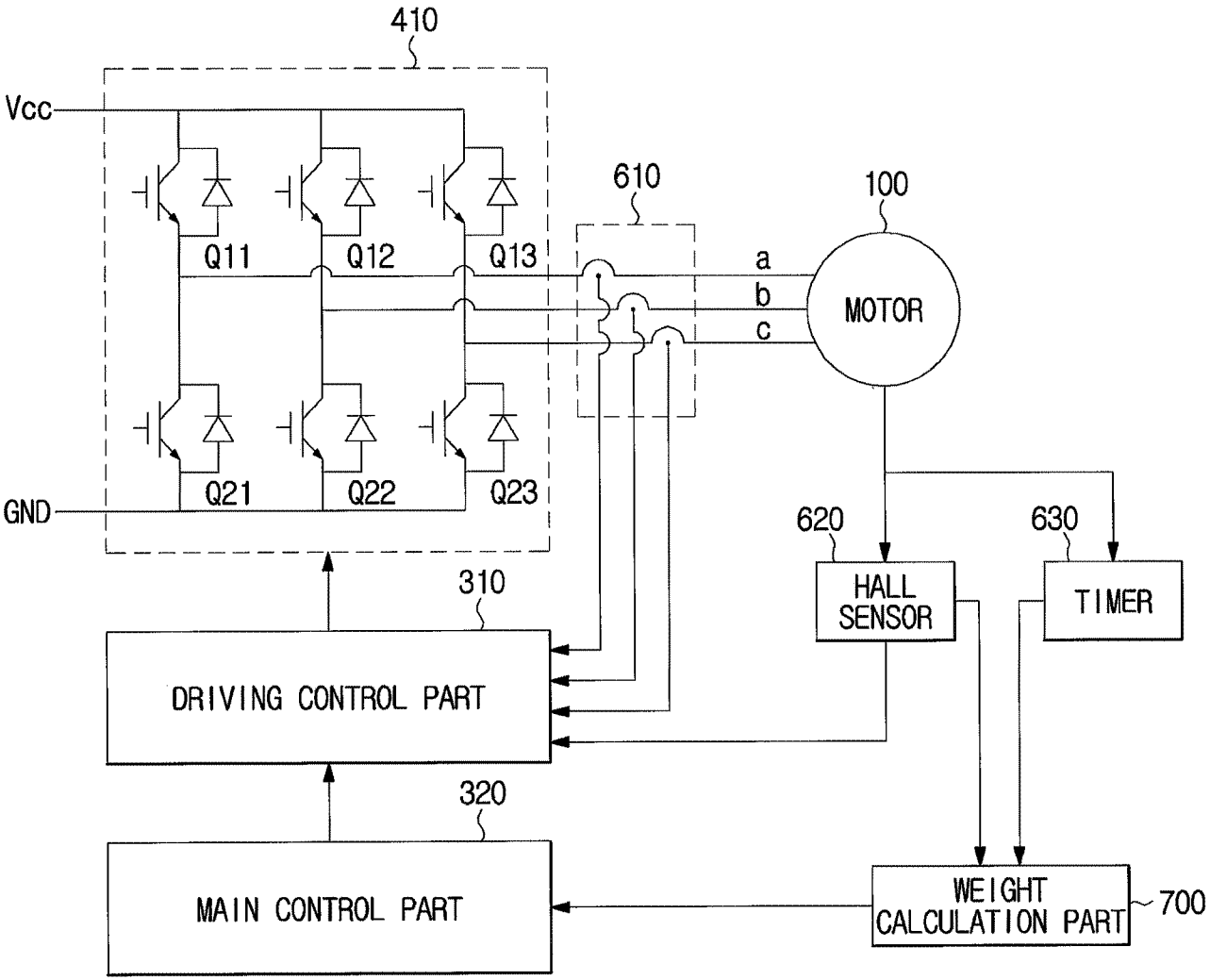
Figure 8:
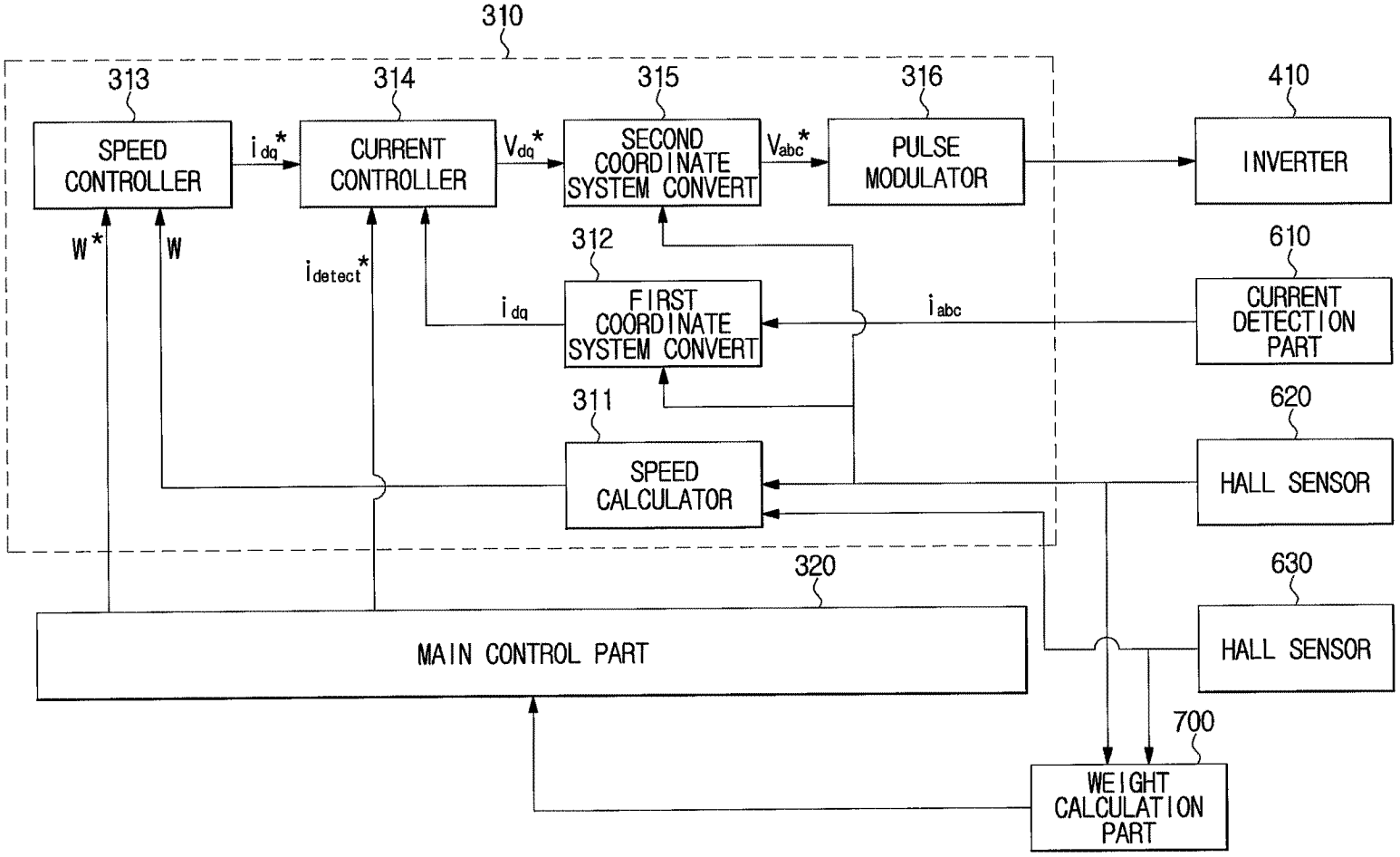

FIGS. 6 to 8 are block diagrams of the driving part, the detection part, the control part and the weight calculation part according to one embodiment.

The driving part 400 may include the driving motor 100 which generates the rotating force, the clutch 200 which transmits the rotating force generated from the driving motor 100 to the washing tub 40 or the pulsator 45, and an inverter 410 which supplies a driving current to the driving motor 100.

The driving motor 100 and the clutch 200 have been described above with reference to FIGS. 2 and 3, and thus the descriptions thereof will be omitted.

As illustrated in FIG. 7, the inverter 410 may include three upper switching circuits Q11 to Q13 and three lower switching circuits Q21 to Q23.

Each of the upper switching circuits Q11 to Q13 and the lower switching circuits Q21 to Q23 may include a high voltage switch, such as a high voltage bipolar junction transistor, a high voltage field effect transistor and an insulated gate bipolar transistor (IGBT), and a free wheeling diode.

Specifically, the three upper switching circuits Q11 to Q13 are connected to a power source Vcc in parallel with each other, and the three lower switching circuits Q21 to Q23 are connected to a ground GND in parallel with each other. Also, the three upper switching circuits Q11 to Q13 and the three lower switching circuits Q21 to Q23 are connected in series one to one, and three nodes to which the three upper switching circuits Q11 to Q13 and the three lower switching circuits Q21 to Q23 are connected respectively are connected to three input terminals a, b and c of the driving motor 100, respectively.

The inverter 410 may turn on one of the upper switching circuits Q11 to Q13 and one of the lower switching circuits Q21 to Q23 according to predetermined priority, and thus may supply the driving current to the driving motor 100.

The detection part 600 may include a current detection part 610 which detects a driving current value, a hall sensor 620 which detects a rotational displacement of the rotor 120, and a timer 630 which measures a detected time.

As illustrated in FIG. 7, the current detection part 610 may detect the driving current value which flows to the three input terminals a, b and c of the driving motor. The current detection part 610 may detect a voltage drop of a shunt resistor connected in series to the input terminals a, b and c of the driving motor 100, or may detect an output of a voltage distributor connected in parallel with the driving motor 100 between the input terminals a, b and c of the driving motor 100 and the ground GND, thereby detecting the driving current value.

The hall sensor 620 is connected to one side of an upper surface of the stator 110. Also, the hall sensor 620 may detect a change in the magnetic field due to rotation of the permanent magnets 123 attached to the rotor 120, and thus may output an angle, a frequency or the like related to the rotational displacement of the rotor 120.

An angle sensor such as a potentiometer, an absolute encoder and an incremental encoder may be used as the hall sensor 620. The potentiometer is an angle sensor for calculating an electrical input which is in direct proportion to the angle rotated with a value of variable resistance changed according to the angle, and the absolute encoder is an angle sensor which does not set a reference position but detects a corresponding position due to a certain degree of rotation using optical pulse waves, and the incremental encoder is an angle sensor which sets the reference position, and calculates the angle through an increase and decrease in a measured angle, and thus detects the corresponding position due to the certain degree of rotation using the optical pulse waves. Also, various kinds of sensors which measure the angle and the frequency may be used as an example of the hall sensor 620.

The timer 630 may measure a time which is required in a laundry weight calculation process or a main process. For example, the timer 630 may measure a driving time at an operation in which the rotor 120 is accelerated by an open circuit current control during the laundry weight calculation process which will be described later.

Also, the detection part 600 may store the detected driving current value, angle, frequency, time or the like in the storage part 530.

The weight calculation part 700 may calculate the weight of the laundry located inside the washing tub 40 through each of the frequencies and the rotated angle of the rotor detected by the hall sensor 620 and the driving time detected by the timer 630.

Specifically, the weight calculation part 700 may calculate a rotating speed at a start point and an end point of the operation, in which the rotor 120 is accelerated by the open circuit current control, through each of the frequencies and the rotated angle of the rotor detected by the hall sensor 620, and then may calculate a change amount of the rotating speed at the operation, in which the rotor 120 is accelerated by the open circuit current control, based on the calculated rotating speed at the start point and the end point. And the weight calculation part 700 may calculate a ratio of the calculated change amount of the rotating speed of the rotor 120 and the driving time in the operation, in which the rotor 120 is accelerated by the open circuit current control, measured by the timer 630.

Here, the end point of the operation in which the rotor 120 is accelerated by the open circuit current control is a point at which the rotor 120 is rotated by a first number of times. The first number of times may be a value set during a manufacturing process, or may be a value input through the operation part 510 by the user. Also, the first number of times is not limited to an integer value, and may be expressed by a decimal value. For example, the first number of times may be once.

Then, the weight calculation part 700 may import data related to the weight of the laundry corresponding to the ratio of the driving time and the change amount of the rotating speed of the rotor 120 from the storage part 530, and thus may calculate the weight of the laundry. Also, the weight calculation part 700 may calculate the weight of the laundry by multiplying the ratio of the driving time and the change amount of the rotating speed of the rotor 120 by a predetermined variable.

Also, the weight calculation part 700 may store the calculated rotating speed of the rotor 120, the change amount of the rotating speed, and the ratio of the driving time and the change amount of the rotating speed in the storage part 530.

The ratio of the driving time and the change amount of the rotating speed of the rotor 120 which is a variable as a reference for calculating the weight of the laundry in the weight calculation part 700 may be expressed by the following Equation 1.

$$S = \frac{\Delta\omega}{\Delta t} \quad \text{Equation 1}$$

Equation 1 is an equation of a variable S as the reference for calculating the weight of the laundry in the weight calculation part 700. In Equation 1, S may be the reference variable for calculating the weight, Δω may be the change amount of the rotating speed in the operation in which the rotor 120 is accelerated by the open circuit current control, and Δt may be the driving time in the operation in which the rotor 120 is accelerated by the open circuit current control.

The weight calculation part 700 may calculate the weight of the laundry by comparing the reference variable S calculated by Equation 1 with corresponding data stored in the storage part 530. The data for calculating the weight of the laundry which is stored in the storage part 530 may be data which is obtained by an experiment and stored in the storage part 530 during the manufacturing process, or may be data which is accumulated while the user uses the washing machine and stored in the storage part 530.

Also, the weight calculation part 700 may calculate the weight of the laundry by multiplying the reference variable S calculated through Equation 1 by a predetermined variable. Here, the predetermined variable may be a value which is obtained by analyzing data obtained by an experiment and stored in the storage part 530 during the manufacturing process, or may be a value which is obtained by analyzing data accumulated while the user uses the washing machine and stored in the storage part 530.

Also, the weight calculation part 700 may store the calculated weight of the laundry in the storage part 530, may repeat several times the laundry weight calculation process, and thus the weight of the laundry may be determined into an average of the calculated weights.

For example, the washing machine 1 performs three times the laundry weight calculation process, and when it is assumed that a weight of the laundry calculated by the weight calculation part 700 in a first laundry weight calculation process is 14 kg, and a weight of the laundry calculated by the weight calculation part 700 in a second laundry weight calculation process is 16 kg, and a weight of the laundry calculated by the weight calculation part 700 in a third laundry weight calculation process is 18 kg, the weight of laundry may be determined into 16 kg, which is an average of the laundry weights calculated through the three laundry weight calculation processes, by the weight calculation part 700.

In addition, various other methods of detecting the weight of the laundry inside the washing tub 40 using a variable detected when the washing tub 40 is accelerated may be used as an example of a weight calculating method in the weight calculation part 700.

The control part 300 may include a main control part 320 which controls the entire operation of the washing machine 1, and a driving control part 310 which controls an operation of the driving part 400.

The main control part 320 may transmit a speed instruction w* or a motor constraint detecting current instruction idetect* to the driving control part 310 according to a user's operation command, and may control the display part 520 to display washing operation information according to the user's operation command. In particular, the main control part 320 may output the speed instruction w* for the driving motor 100 during the washing process, the rinsing process and the spin-drying process, and the motor constraint detecting current instruction idetect* for detecting whether the driving motor is constrained during the washing process and the rinsing process.

As illustrated in FIG. 8, the driving control part 310 may include a speed calculator 311, a speed controller 313, a first coordinate system converter 312, a current controller 314, a second coordinate system converter 315, and a pulse width modulator 316.

The speed calculator 311 may calculate a rotating speed w of the driving motor 100 based on the driving time provided by the timer 630 and the rotated angle and the frequency of the rotor 120 provided by the hall sensor 620 included in the driving motor 100, and thus may provide the rotating speed w to the speed controller 313 and the main control part 320.

The speed controller 313 may calculate a dq-axial current instruction idq* using a difference between the speed instruction w* output from the main control part 320 and the rotating speed w of the driving motor 100 output from the speed calculator 311, and then may provide the dq-axial current instruction idq* to the current controller 314.

The first coordinate system converter 312 may convert a three-phase driving current value iabc of the driving motor 100 output from the current detection part 610 into a dq-axial current value idq based on the rotational displacement of the rotor 120 output from the hall sensor 620, and then may provide the converted dq-axial current value idq to the current controller 314.

The current controller 314 may calculate a dq-axial voltage instruction vdq* using a difference between the dq-axial current instruction idq* output from the speed controller 313 and the dq-axial current value idq output from the first coordinate system converter 312, or may calculate the dq-axial voltage instruction vdq* using a difference between the motor constraint detecting current instruction idetect* output from the main control part 320 and the dq-axial current value idq output from the first coordinate system converter 312, and then may provide the dq-axial voltage instruction vdq* to the second coordinate system converter 315.

Also, the current controller 314 may control a d-axial current component and a q-axial current component in the laundry weight calculation process according to a control signal of the main control part 320. That is, the current controller 314 may increase or maintain the d-axial current component, and may also control the d-axial current component to have a negative value. Also, the current controller 314 may increase or maintain the q-axial current component.

The second coordinate system converter 315 may convert the dq-axial voltage instruction vdq* output from the current controller 314 into a three-phase voltage instruction vabc* based on the rotational displacement of the rotor 120 output from the hall sensor 620, and may provide the converted three-phase voltage instruction vabc* to the pulse width modulator 316.

The pulse width modulator 316 may output a pulse width modulation signal for controlling the upper switching circuits Q11 to Q13 and the lower switching circuits Q21 to Q23 based on the three-phase voltage instruction vabc* output from the second coordinate system converter 315.

In brief, the driving control part 310 outputs the pulse width modulation signal for controlling the inverter 410 according to the speed instruction w* or the motor constraint detecting current instruction idetect* output from the main control part 320.

Specifically, when the speed instruction w* is input from the main control part 320, the driving control part 310 calculates the rotating speed w of the driving motor 100 using the rotational displacement of the rotor 120 which is fed back from the hall sensor 620 of the driving motor 100, compares the rotating speed w with the speed instruction w*, and controls the driving current of the driving motor 100. Also, when the motor constraint detecting current instruction idetect* is input from the main control part 320, the driving control part 310 feeds forward the motor constraint detecting current instruction idetect* to the driving motor 100.

Until now, the configuration of the washing machine according to one embodiment has been described.

Hereinafter, the operation of the washing machine according to one embodiment will be described.

One embodiment of the laundry weight calculation process will be described with reference to FIGS. 9*a* and 9*b*.

Figure 9A:
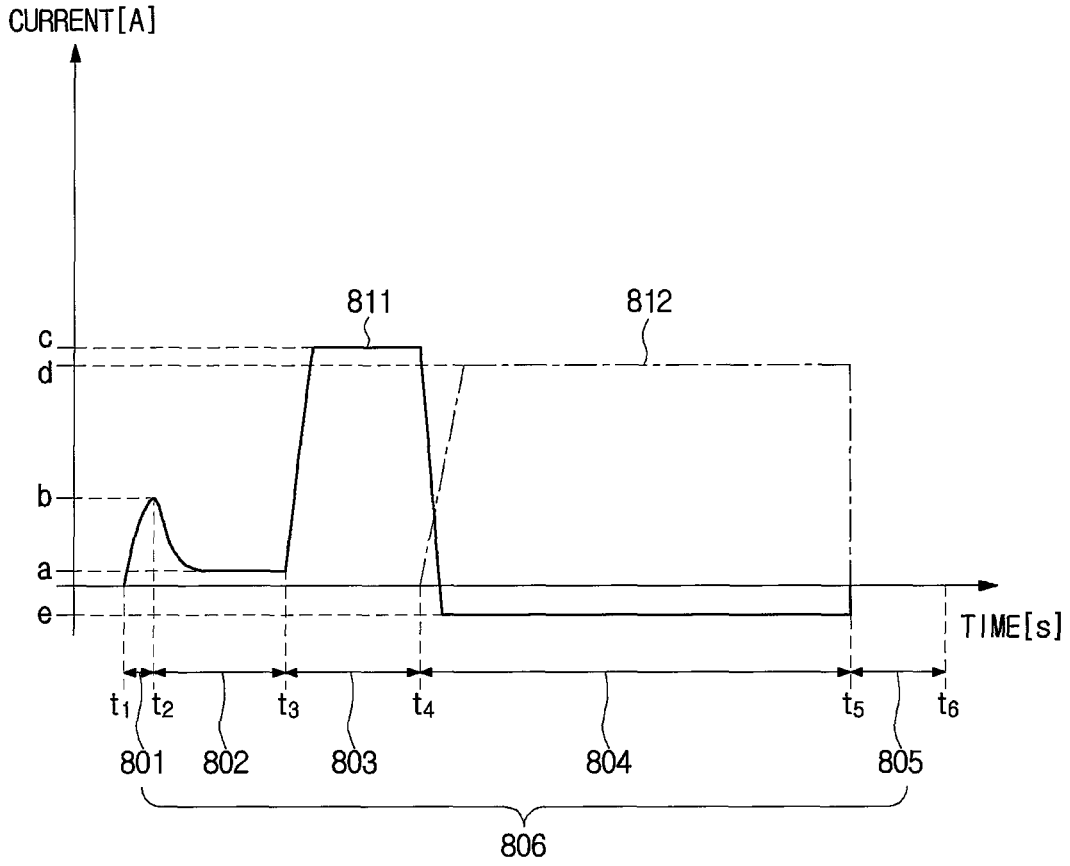
FIG. 9*a* is a graph of D-axial and Q-axial currents flowing through a stator when a weight of laundry is calculated according to one embodiment.
Figure 9B:
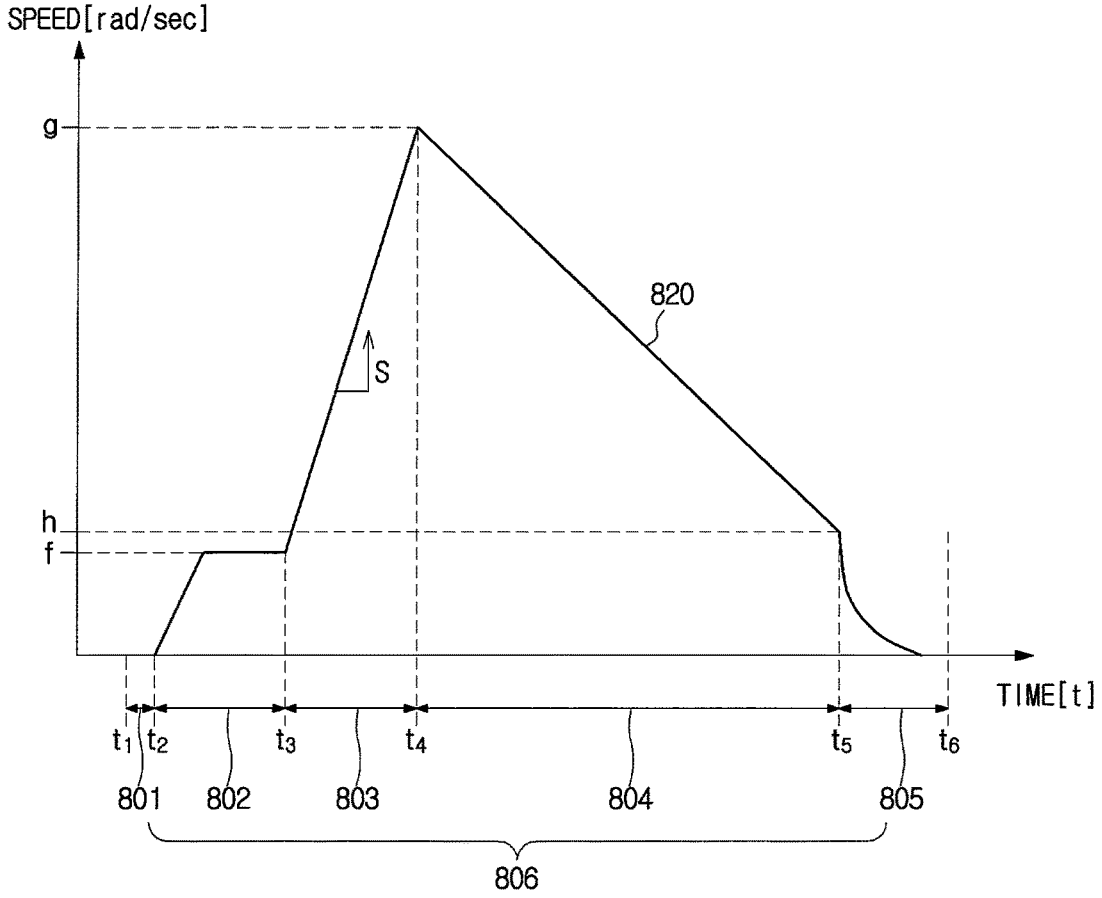
FIG. 9*b* is a graph of a rotating speed of a rotor when the weight of the laundry is calculated according to one embodiment.

FIG. 9*a* is a graph of D-axial and Q-axial currents flowing through the stator when the weight of the laundry is calculated, and FIG. 9*b* is a graph of the rotating speed of the rotor when the weight of the laundry is calculated.

The laundry weight calculation process 806 may include a first operation 801, a second operation 802, a third operation 803, a fourth operation 804 and a fifth operation 805.

The first operation 801 is an opening operation of the laundry weight calculation process and corresponds to a time from t1 [s] to t2 [s]. In the first operation 801, a q-axial current for controlling a torque component of the driving motor 100 is increased to a [A], and a d-axial current for controlling a flux component is maintained at 0 [A]. However, in the first operation 801, the rotating speed 820 of the rotor 120 is 0 [rpm], and the rotor 120 is maintained at a stopped state due to a friction force of the rotor 120, a lag time at which an attractive force and a repulsive force acts between the magnetic field of the stator 110 and the magnetic field of the rotor 120, and other reasons.

The second operation 802 is an operation in which the rotating speed 820 of the rotor 120 is increased and maintained through a closed circuit speed control, and corresponds to a time from t2 [s] to t3 [s]. In the second operation 802, the q-axial current for controlling the torque component of the driving motor 100 is reduced to b [A], and then maintained at b [A] until the second operation 802 is finished, and the d-axial current for controlling the flux component is maintained at 0 [A]. Therefore, in the second operation 802, the rotating speed 820 of the rotor 120 is increased to a first speed of f [rpm], fed back from the hall sensor 620 and the timer 630, and maintained at the first speed of f [rpm] until a finish time of t3 [s].

The third operation 803 is an operation at which the rotating speed 820 of the rotor 120 is increased through the open circuit current control and the weight of the laundry is calculated, and corresponds to a time from t3 [s] to t4 [s] when the rotor 120 is rotated by a predetermined first number of times. In the third operation 803, the q-axial current for controlling the torque component of the driving motor 100 is increased to a first current of c [A], and then maintained at the first current of c [A] until the third operation 803 is finished, and the d-axial current for controlling the flux component is maintained at 0 [A]. Therefore, in the third operation 803, the rotating speed 820 of the rotor 120 is increased to a value of g [rpm] which is varied according to the weight of the laundry.

In this case, the weight calculation part 700 may calculate a slope S which is a ratio of g-f [rpm] as the change amount of the rotating speed 820 in the third operation 803 and t4–t3 [s] as the driving time in the third operation 803, may import the laundry weight calculation data corresponding to the slope S from the storage part 530, and thus may calculate the weight of the laundry, or may calculate the weight of the laundry by multiplying the slope S by a predetermined variable.

Also, in the third operation 803, the driving time of t4–t3 [s] is a time when the rotor 120 is rotated by the predetermined first number of times. The first number of times may be a value which is set during the manufacturing process, or may be a value which is input through the operation part 510 by the user. Also, the first number of times is not limited to an integer value, and may be expressed by a decimal value. For example, the first number of times may be once.

The fourth operation 804 is an operation at which the rotating speed 820 of the rotor 120 is increased through the open circuit current control and the weight of the laundry is calculated, and corresponds to a time from t4 [s] to t5 [s]. In the fourth operation 804, the q-axial current for controlling the torque component of the driving motor 100 is reduced to a second current of e [A] in a negative direction, and thus a torque is applied in a direction opposite to a currently rotating direction. Therefore, the rotating speed 820 of the rotor 120 is reduced from f [rpm] to a second speed of h [rpm] due to the torque applied in the direction opposite to the rotating direction.

However, a counter electromotive force is detected at the stator 110 and the rotor 120 due to inertia and the q-axial current flowing in the negative direction, and thus a value of a DC input voltage Vcc of the inverter 410 is increased.

Therefore, in the fourth operation 804, a third current of d [A] as the d-axial current for controlling the flux component flows in a positive direction, and thus the counter electromotive force generated at the inverter 410 may be consumed while having less of an effect on the rotating speed 820. Therefore, in the fourth operation 804, even when the second current of e [A] as the q-axial current flows in the negative direction, the value of the DC input voltage Vcc of the inverter 410 may be maintained.

Therefore, in the fourth operation 804, the rotating speed 820 of the rotor 120 is gradually reduced to the second speed of h [rpm] at the time of t5 [s].

Also, in the fourth operation 804, the second speed of h [rpm] is determined by a variable such as a weight of each of the clutch 200 and the tub 30 or the like connected to the driving motor 100, and the required torque and the required rotating speed 820 upon the laundry weight calculation. The second speed of h [rpm] may be a value which is set during the manufacturing process, or may be a value which is input through the operation part 510 by the user. For example, the second speed of h [rpm] may have the same value as that of the first speed of f [rpm].

The fifth operation 805 is an operation at which the rotor 120 is stopped through the brake assembly 240, and corresponds to a time of t5 [s] to t6 [s]. In the fifth operation 805, the q-axial current for controlling the torque component of the driving motor 100 and the d-axial current for controlling the flux component are maintained at 0 [A]. However, the rotating speed 820 of the rotor 120 is reduced from the second speed of h [rpm] to 0 [rpm] by the physical braking force of the brake assembly 240. Also, in this case, in the fourth operation 804, since the rotating speed 820 of the rotor 120 is in a decelerated state to a low speed due to an electromagnetic braking force of the q-axial current and the d-axial current, a noise due to a gap between the clutch 200 and the other elements may not be loud.

Therefore, by a dual braking system using the electromagnetic braking force of the fourth operation 804 and the physical braking force of the fifth operation 805, a time for calculating the weight in the laundry weight calculation process 806 may be reduced, and the noise generated when the rotor 120 is decelerated may be reduced.

Also, the washing machine 1 may repeatedly perform the laundry weight calculation process 806 for reliability of the calculated weight of the laundry. For example, in the washing machine 1, an average value of the laundry weights which is calculated by repeating three times the laundry weight calculation process 806 may, be determined as the weight of the laundry inside the washing tub 40.

Here, an open circuit control is a control method in which only an input is concerned but an output is not concerned when the control part controls the output, and thus an output variable is directly controlled by an input variable, and may be referred to as a feed forward control, because a feedback loop for an operation of an object to be controlled is not provided. On the contrary, a closed circuit control is a control method in which a control signal is modified and corrected so that a target value coincides with a control value, and may be referred to as a feedback control in which an error between an input signal and a feedback signal is controlled. For example, the closed circuit speed control may receive a feedback signal with respect to the rotational displacement of the rotor detected by the control part, and thus may maintain the rotating speed at a predetermined speed.

The current of a [A] to e [A] corresponding to the q-axial current and the d-axial current flowing through the stator 110 in the laundry weight calculation process 806 is a value which is determined by the variable such as the weight of each of the clutch 200 and the tub 30 or the like connected to the driving motor 100, and the required torque and the required rotating speed 820 upon the laundry weight calculation, and may be changed according to the applied washing machine 1 and a service environment thereof.

Also, the speed of f [rpm] to h [rpm] corresponding to the rotating speed of the rotor 120 in the laundry weight calculation process 806 is a value which is determined by the variable such as the weight of each of the clutch 200 and the tub 30 or the like connected to the driving motor 100, and the required torque and the required rotating speed 820 upon the laundry weight calculation, and may be changed according to the applied washing machine 1 and the service environment thereof.

Also, the time of t1 [s] to t6 [s] of the laundry weight calculation process 806 is a value which is determined by the variable such as the weight of each of the clutch 200 and the tub 30 or the like connected to the driving motor 100, and the required torque and the required rotating speed 820 upon the laundry weight calculation, and may be changed according to the applied washing machine 1 and the service environment thereof.

Hereinafter, a procedure of the laundry weight calculation process in the washing machine according to one embodiment will be described with reference to FIGS. 10*a* and 10*b*.

Figure 10A:
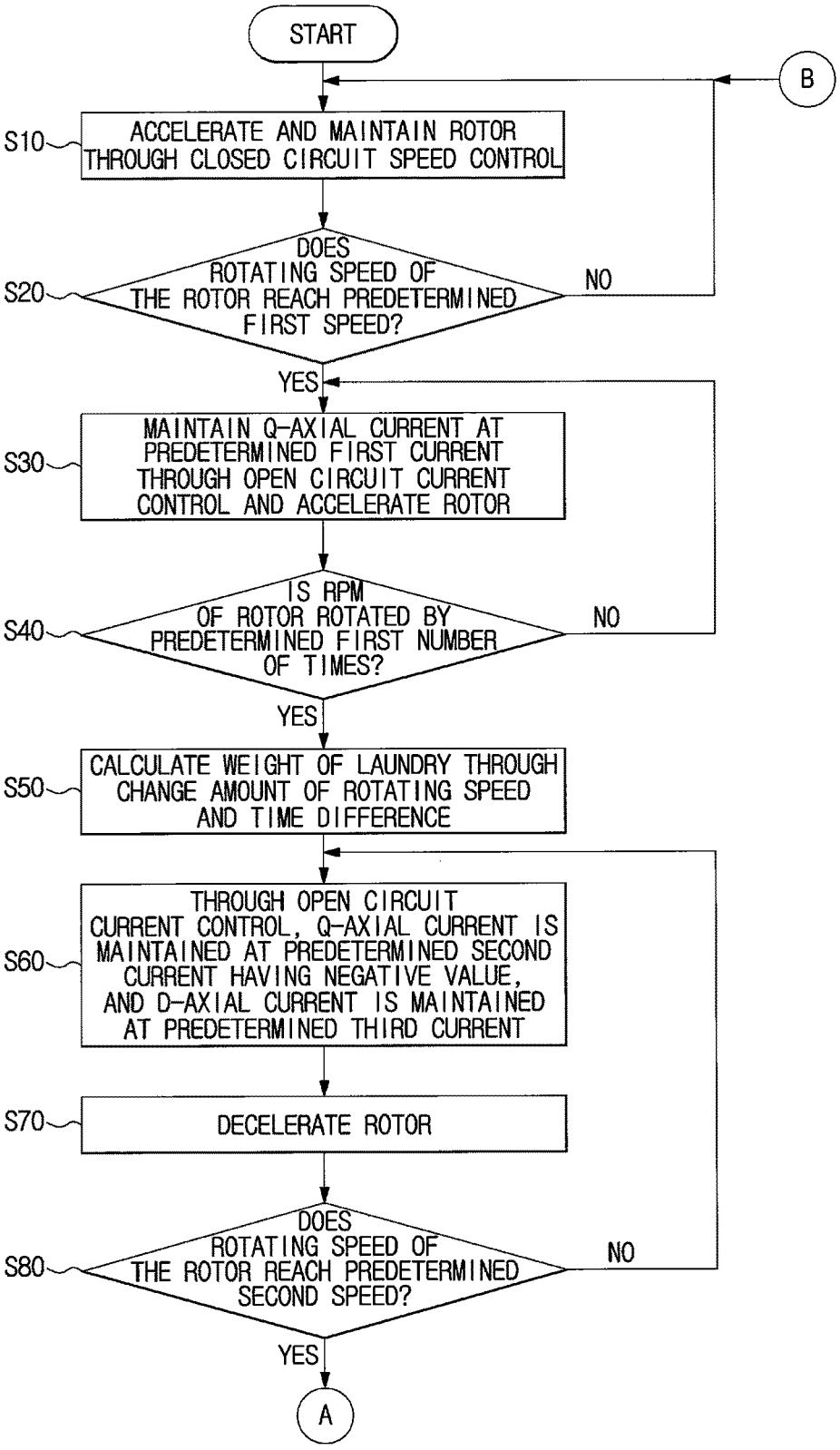
FIGS. 10*a* and 10*b* are flowcharts illustrating a process of calculating the weight of the laundry and controlling the rotor to be accelerated and decelerated.
Figure 10B:
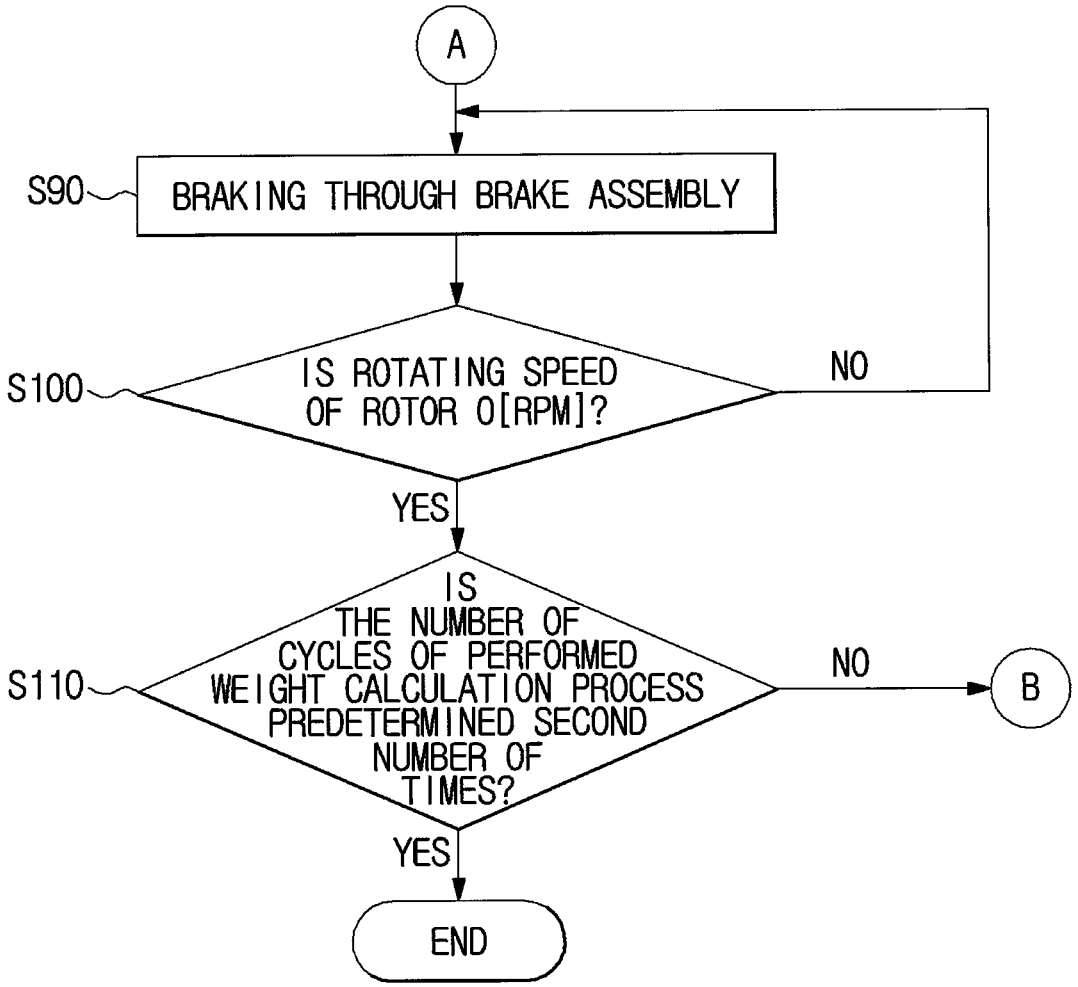

FIGS. 10*a* and 10*b* are flowcharts illustrating a process of calculating the weight of the laundry and controlling the rotor to be accelerated and decelerated.

First, as illustrated in FIG. 10*a*, the driving control part applies the q-axial current through the closed circuit speed control, accelerates the rotor without applying of the q-axial current, and maintains the rotating speed of the rotor at the predetermined speed (S10). And the driving control part calculates the present rotating speed of the rotor through the variables detected by the hall sensor and the timer, and then determines whether the calculated speed is the preset first speed (S20).

When the present rotating speed of the rotor is not the first speed, the driving control part performs again the operation of S10, and controls the rotating speed of the rotor to be the first speed. However, when the present rotating speed of the rotor is the first speed, the main control part transfers a control signal to the driving control part, and the driving control part which receives the control signal increases and maintains the q-axial current for controlling the torque component through the open circuit current control to/at the first current, and thus controls the rotor to be accelerated (S30).

And the driving control part calculates a present rpm of the rotor through the variable detected by the hall sensor, and determines whether the calculated rpm of the rotor coincides with the preset first number of times (S40).

When the rpm of the rotor is smaller than the first number of times, the driving control part performs again the operation of S30, and controls the rpm of the rotor to be the first number of times. However, when the rotor is rotated by the first number of times, the weight calculation part may calculate the weight of the laundry through the change amount of the rotating speed and the time difference, which are the variables detected by the hall sensor and the timer (S50).

Then, the main control part transfers the control signal to the driving control part, and the driving control part which receives the control signal reduces the q-axial current for controlling the torque component through the open circuit current control to the second current having a negative value, and increases the d-axial current for controlling the flux component to the third current, and then maintains the current value (S60).

Accordingly, the rotor is decelerated by the electromagnetic braking force (S70). And the driving control part calculates the present rotating speed of the rotor through the variables detected by the hall sensor and the timer, and then determines whether the calculated speed is the second speed (S80).

When the present rotating speed of the rotor is not the second speed, the driving control part performs again the operations of S60 and S70, and controls the rotating speed of the rotor to be the second speed. However, when the present rotating speed of the rotor is the second speed, the operation is moved to A located at a lower end of FIG. 10*a*, and the main control part operates the brake assembly, and stops the rotor through the physical braking force (S90).

Then, the driving control part calculates the present rotating speed of the rotor through the variables detected by the hall sensor and the timer, and determines whether the calculated rotating speed is 0 [rpm] (S100).

When the present rotating speed of the rotor is not 0 [rpm], the main control part continuously drives the brake assembly, and controls the rotating speed of the rotor to be 0 [rpm]. However, when the present rotating speed of the rotor is 0 [rpm], the main control part determines whether the number of cycles of the performed laundry weight calculation process is a preset second number of times (S110).

When the number of cycles of the performed laundry weight calculation process is not the second number of times, the operation is returned to B illustrated at an upper end of FIG. 10*a*, and the operations from S10 to S100 are performed again. However, when the number of cycles of the performed laundry weight calculation process is the second number of times, the washing machine terminates the laundry weight calculation process.

It will be understood that the foregoing description of the present invention is for illustrative purposes only, and that, for ordinary person in the art, various substitutions, alterations and changes can be made without any change in the technical spirit or the essential characteristics of the present invention. Therefore, the above-described embodiments are to illustrate, not to limit the scope of the present invention. The scope of the present invention should be construed by the appended claims, along with the full range of equivalents to which such claims are entitled.

The invention claimed is:

1. A method of controlling a washing machine, comprising:

accelerating a motor to spin a washing tub;

calculating a weight of laundry inside the washing tub based on a rotational displacement of the motor while the motor is accelerated;

providing an electronic braking force to the motor, in a direction opposite to a rotating direction of the motor to decelerate the motor, wherein the motor is decelerated to a predetermined speed that is greater than zero revolutions per minute; and in response to decelerating the motor to the predetermined speed, stopping the motor using a brake assembly that provides a physical braking force, wherein providing the physical braking force by the brake assembly comprises:

generating the physical braking force when a brake band is in contact with a reduction gear accommodation part housing a reduction gear assembly, and when the brake band is in contact with the reduction gear accommodation part, preventing a spin drying shaft from rotating in a first direction and not preventing the spin drying shaft from rotating in a second direction, wherein the first direction is opposite the second direction.

2. The method of claim 1, wherein:

accelerating the motor comprises:

accelerating the motor to a preset first speed through a closed circuit speed control, and after accelerating the motor to the preset first speed, continue accelerating the motor by rotating the motor by a first number of times through an open circuit current control, and wherein the predetermined speed is a preset second speed.

3. The method of claim 1, wherein providing the electronic braking force in the direction opposite to the rotating direction of the motor comprises applying a q-axial current to the motor in a negative direction.

4. The method of claim 3, further comprises applying a d-axial current to the motor in a positive direction to reduce a voltage rise due to a change in the q-axial current.

5. The method of claim 2, further comprising when the motor is accelerated through the open circuit current control, maintaining a q-axial current at a predetermined value.

6. The method of claim 1, wherein accelerating the motor and providing the electronic braking force to the motor are repeated a predetermined number of times.

7. The method of claim 2, wherein the first number of times is once.

8. The method of claim 1, further comprises detecting the rotational displacement of the motor, wherein the rotational displacement of the motor indicates a change in a rotating speed of the motor and a driving time.

9. The method of claim 1, wherein calculating the weight of laundry is based on a ratio of a change in a rotating speed of the motor and a driving time.

* * * * *